US009651258B2

(12) United States Patent
Graves et al.

(10) Patent No.: US 9,651,258 B2
(45) **Date of Patent: *May 16, 2017**

(54) SHELL AND TILED LINER ARRANGEMENT FOR A COMBUSTOR

(71) Applicant: Rolls-Royce Corporation, Indianapolis, IN (US)

(72) Inventors: Charles B. Graves, Avon, IN (US); William G. Cummings, III, Indianapolis, IN (US); Russell N. Bennett, Indianapolis, IN (US); Jun Shi, Carmel, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 602 days.

This patent is subject to a terminal disclaimer.

(21) Appl. No.: 14/134,840

(22) Filed: Dec. 19, 2013

(65) Prior Publication Data

US 2015/0330633 A1 Nov. 19, 2015

Related U.S. Application Data

(60) Provisional application No. 61/798,253, filed on Mar. 15, 2013.

(51) Int. Cl.
*F02C 1/00* (2006.01)
*F23R 3/00* (2006.01)

(52) U.S. Cl.
CPC ..... *F23R 3/002* (2013.01); *F23R 3/007* (2013.01); *F23R 2900/00017* (2013.01); *Y10T 29/49229* (2015.01)

(58) Field of Classification Search
CPC .. F23R 3/002; F23R 3/007; F23R 3/60; F23R 3/50; F23R 2900/00005; F02C 7/20
See application file for complete search history.

(56) References Cited

U.S. PATENT DOCUMENTS

| | | | |
|---|---|---|---|
| 2,709,894 | A | 6/1955 | Oulianoff et al. |
| 3,422,620 | A | 1/1969 | Fantozzi et al. |
| 3,899,876 | A | 8/1975 | Williamson et al. |
| 3,918,255 | A | 11/1975 | Holden |
| 4,222,300 | A | 9/1980 | El Habr |
| 4,236,378 | A | 12/1980 | Vogt et al. |
| 4,480,436 | A | 11/1984 | Maclin |
| 4,555,901 | A | 12/1985 | Wakeman |
| 4,567,730 | A | 2/1986 | Scott |
| 4,614,082 | A | 9/1986 | Sterman et al. |
| 4,655,044 | A | 4/1987 | Dierberger et al. |
| 4,688,310 | A | 8/1987 | Kelm et al. |
| 4,901,522 | A | 2/1990 | Commaret et al. |
| 4,907,411 | A | 3/1990 | Krueger |

(Continued)

FOREIGN PATENT DOCUMENTS

EP 1801502 A2 6/2007

OTHER PUBLICATIONS

International Search Report for PCT International Application Serial No. PCT/US2013/076696.

*Primary Examiner* — Gerald L Sung
(74) *Attorney, Agent, or Firm* — Barnes & Thornburg LLP

(57) ABSTRACT

A combustor for use in a gas turbine engine includes a liner with a plurality of tiles coupled to a shell via a plurality of fasteners. Each of the plurality of fasteners extends through at least one of the tiles.

15 Claims, 7 Drawing Sheets

(56) References Cited

U.S. PATENT DOCUMENTS 4,912,922 A * 4/1990 Maclin ..... F23R 3/002 60/757
4,944,151 A * 7/1990 Hovnanian ..... F23R 3/002 60/752
4,975,014 A 12/1990 Rufin et al.
5,079,915 A 1/1992 Veau
5,113,660 A 5/1992 Able et al.
5,291,732 A 3/1994 Halila
5,331,816 A 7/1994 Able et al.
5,333,443 A 8/1994 Halila
5,343,643 A 9/1994 Cochrane
5,363,643 A 11/1994 Halila
5,445,469 A 8/1995 Huck et al.
5,499,499 A 3/1996 Ambrogi et al.
5,501,071 A 3/1996 Ansart et al.
5,553,455 A 9/1996 Craig et al.
5,592,814 A 1/1997 Palusis et al.
5,598,697 A 2/1997 Ambrogi et al.
5,609,031 A 3/1997 Jones
5,636,508 A 6/1997 Shaffer et al.
5,755,093 A 5/1998 Palusis et al.
5,799,491 A 9/1998 Bell et al.
6,029,455 A * 2/2000 Sandelis ..... F23R 3/002 60/752
6,041,590 A 3/2000 Hayton et al.
6,045,310 A 4/2000 Miller et al.
6,047,539 A 4/2000 Farmer et al.
6,102,610 A 8/2000 Palusis et al.
6,223,538 B1 5/2001 Benz et al.
6,334,298 B1 1/2002 Aicholtz
6,408,628 B1 6/2002 Pidcock et al.
6,571,560 B2 6/2003 Tatsumi et al.
6,708,495 B2 3/2004 Calvez et al.
6,718,774 B2 4/2004 Razzell
6,775,985 B2 8/2004 Mitchell et al.
6,823,676 B2 11/2004 Conete et al.
6,830,437 B2 12/2004 Cairo et al.
6,895,757 B2 5/2005 Mitchell et al.
6,895,761 B2 5/2005 Mitchell et al.
6,904,757 B2 6/2005 Mitchell et al.
6,931,855 B2 8/2005 Glessner et al.
7,059,133 B2 6/2006 Gerendas
7,093,441 B2 8/2006 Burd et al.
7,140,185 B2 11/2006 Burd et al.
7,153,054 B2 12/2006 Arbona
7,237,389 B2 7/2007 Ryan et al.
7,261,489 B2 8/2007 Arbona et al.
7,291,407 B2 11/2007 Merrill et al.
7,363,763 B2 4/2008 Coughlan et al.
7,464,554 B2 12/2008 Cheung et al.
7,546,743 B2 6/2009 Bulman et al.
7,647,779 B2 1/2010 Shi et al.
7,665,307 B2 2/2010 Burd et al.
7,805,945 B2 10/2010 Grote et al.
7,908,867 B2 3/2011 Keller et al.
7,926,278 B2 4/2011 Gerendas et al.
7,942,004 B2 5/2011 Hodder
7,950,234 B2 5/2011 Radonovich et al.
8,015,829 B2 9/2011 Coughlan et al.
8,074,453 B2 12/2011 Gerendas et al.
8,113,004 B2 2/2012 Carlisle et al.
8,118,546 B2 2/2012 Morrison
8,122,727 B2 2/2012 Shi et al.
8,141,371 B1 3/2012 Habarou et al.
8,146,372 B2 4/2012 Carrere et al.
8,256,223 B2 9/2012 Dierberger et al.
8,256,224 B2 9/2012 Garry et al.
8,281,598 B2 10/2012 Gerendas et al.
8,359,865 B2 1/2013 Dierberger et al.
8,359,866 B2 1/2013 Dierberger et al.
8,556,531 B1 10/2013 Bird et al.
2003/0123953 A1* 7/2003 Razzell ..... F01D 25/243 411/419
2004/0182085 A1 9/2004 Jeppel et al.
2008/0104963 A1 5/2008 Grote et al.
2009/0193013 A1 7/2009 Hazlewood et al.
2009/0199837 A1 8/2009 Tschirren et al.
2010/0242486 A1 9/2010 Jarmon et al.
2010/0251721 A1 10/2010 Morrison et al.
2011/0027569 A1 2/2011 Richards
2011/0030378 A1 2/2011 Carlisle
2011/0185737 A1 8/2011 Dierberger et al.
2011/0185740 A1 8/2011 Dierberger et al.
2012/0144835 A1 6/2012 Taylor et al.
2012/0198854 A1 8/2012 Schilp et al.
2012/0210719 A1 8/2012 Dierberger et al.
2012/0234402 A1 9/2012 Richards
2012/0275900 A1 11/2012 Snider et al.
2013/0019603 A1 1/2013 Dierberger et al.
2014/0360196 A1* 12/2014 Graves ..... F23R 3/002 60/753
2015/0330633 A1 11/2015 Graves et al.

* cited by examiner

SHELL AND TILED LINER ARRANGEMENT FOR A COMBUSTOR

CROSS-REFERENCE TO RELATED APPLICATION

This application claims the benefit of and priority to U.S. Provisional Patent Application Ser. No. 61/798,253, filed Mar. 15, 2013, which is incorporated herein by this reference.

FIELD OF THE DISCLOSURE

The present disclosure relates generally to liners used in gas turbine engines, and more specifically to ceramic matrix composite (CMC) combustor liners.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft.

Combustors and turbines made of metal alloys requiring significant cooling to be maintained at or below their maximum use temperatures. The operational efficiencies of gas turbine engines are increased with the use of ceramic matrix composite (CMC) materials that require less cooling and having operating temperatures which exceed the maximum use temperatures of metal alloys. The reduced cooling required by CMC combustor liners when compared to metal alloys permits combustor profiles to be flattened and thereby leads to reduced NOx emmisions.

CMC combustor liners sometimes utilize a single wall design in which a single wall having an inner liner wall and an outer liner wall is formed using a pair of hoops. Accomplishing a transition between the CMC liner material and a metal shell surrounding the liner material is a significant concern. The selection of means for attaching the liners used in CMC tiled liners to the surrounding metal shell also poses significant challenges.

SUMMARY

The present application discloses one or more of the features recited in the appended claims and/or the following features which, alone or in any combination, may comprise patentable subject matter.

According to one aspect of the present disclosure, a combustor for use in a gas turbine engine may include an annular metallic shell and an annular liner. The annular metallic shell may form an annular cavity. The annular liner may be arranged in the annular cavity of the annular metallic shell and may define an annular combustion chamber. The annular liner may include a first ceramic tile coupled to the metallic shell by a first fastener extending through the first ceramic tile and a second ceramic tile coupled to the metallic shell by a second fastener extending through the second ceramic tile. An overlapped portion of the first ceramic tile may be arranged to extend between the second fastener and the annular combustion chamber to shield the second fastener from the annular combustion chamber.

In some embodiments, the combustor may include a heat shield. The heat shield may be arranged to extend between the first fastener that extends through the first ceramic tile to shield the first fastener from the annular combustion chamber.

In some embodiments, the annular metallic shell may include an annular outer shell member and an annular inner shell member concentrically nested inside the annular outer shell member. The annular inner shell member may be formed to include joggles (or steps) extending inwardly (or outwardly) in the radial direction.

In some embodiments, the annular inner shell member may be formed to include dimples extending outward in the in the radial direction. The annular outer shell member may be formed to include dimples extending inward in the radial direction.

In some embodiments, the first ceramic tile may be formed to include a radially-inwardly opening hollow sized and arranged to receive at least a portion of one of the dimples included in the annular inner shell member. The second ceramic tile may be formed to include a radially-inwardly opening hollow sized and arranged to receive at least a portion of another one of the dimples included in the annular inner shell member.

In some embodiments, the first fastener and the second fastener may be formed to include passages configured to receive active cooling air. The combustor may also include at least one fuel nozzle arranged to inject fuel into the annular combustion chamber.

In some embodiments, the second ceramic tile may include a body and at least one tab extending from the body. The second fastener may extend through one of the tabs included in the second ceramic tile.

According to another aspect of the present disclosure, a method for assembling a liner for a combustor of a gas turbine engine comprises positioning a first end of a first tile included in the liner against a first joggled portion of a shell included in the liner, positioning a second tile included in the liner against a second joggled portion of the shell so that a second end of the first tile engages the second tile and the first tile overlaps the second tile, fastening the first tile to the shell using a first fastener, and fastening the second tile to the shell using a second fastener so that the second fastener is sheltered from heat generated by the combustor by the first tile.

These and other features of the present disclosure will become more apparent from the following description of the illustrative embodiments.

DETAILED DESCRIPTION OF THE DRAWINGS

Figure 1:
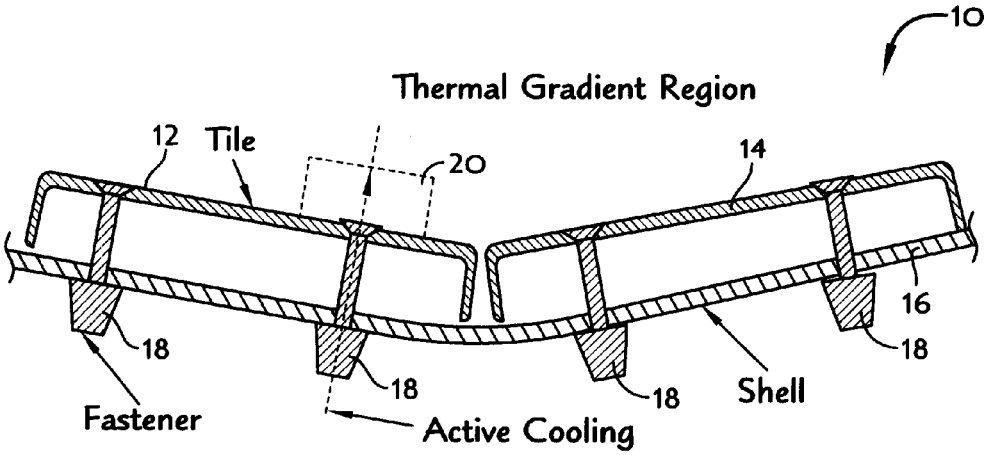
FIG. 1 is a side view of a ceramic matrix composite (CMC) combustor liner in a first embodiment of the present disclosure in which a plurality of tiles are arranged side-by-side and coupled to a shell through fasteners.

For the purposes of promoting an understanding of the principles of the disclosure, reference will now be made to a number of illustrative embodiments illustrated in the drawings and specific language will be used to describe the same.

CMC combustor liners offer many advantages to engine performance. CMC combustor liners require less cooling than metal alloys typically used combustors and turbines, and the reduction in liner cooling permits a flattening of the combustor profile to be achieved. Higher turbine inlet temperatures and flatter combustor profiles lead to reduced NOx emissions. In addition, reduced liner cooling allows a greater fraction of airflow in the gas turbine engine to be dedicated to the combustion process. As a result, in a "lean" burn application, greater airflow for combustion provides a reduction in emissions and/or provides a greater temperature increase for a given emissions level. In a "rich" burn application, greater airflow for combustion allows more air used to be used for quenching and provides reduced NOx emissions.

The principal advantage to any CMC combustor liner is cost. The driving cost of the CMC combustor liner fabrication process is furnace time, which is approximately three weeks. Given the high temperatures that must be maintained to properly cure the CMC combustor liner, the cost of the CMC combustor liner fabrication process is high. The single wall CMC combustor liner design allows for one combustor to be cured at a time in the furnace. However, the CMC tiled liner design allows tiles for several combustors to be cured at the same time which provides for dramatic cost savings. For example, the overall cost of the fabrication process for the CMC tiled liner design may be one half of the cost of the single wall CMC liner design for a wall liner of the same size.

One advantage of the disclosed CMC tiled liner design is how to attach the tiles to the surrounding metal shell. Metal fasteners lose their strength and even melt at CMC combustor liner operating temperatures. CMC fasteners are not as strong as a metal fastener of equivalent size by almost an order of magnitude, and CMC fasteners do not permit the tile to be snugly fastened to the shell in the same way that screw threads do. Since the operating temperature of the metal fastener is so much lower than the operating temperature of the CMC combustor liner, cooling the metal fastener to preserve its strength would in most cases undo the desired high temperature capability of the CMC combustor liner.

Referring now to FIG. 1, a first embodiment of the present disclosure of a CMC combustor liner 10 is shown. A first tile 12 included in the combustor liner 10 is positioned adjacent to a second tile 14 included in the combustor liner 10. Each of the tiles 12, 14 is fastened to a shell 16 included in the combustor liner 10 using one or more metallic fasteners 18 included in the combustor liner 10. Each metallic fastener 18 contacts each tile 12, 14 and the shell 16 as shown in FIG. 1, and each metallic fastener 18 is positioned proximate to the ends of each tile to secure each tile to the shell 16 (i.e. two fasteners 18 secure the two ends of each tile). Each metallic fastener 18 requires active cooling during use, and as a result, a thermal gradient region 20 is established in the area that immediately surrounds each fastener 18 and the exposed region of each tile 12, 14. For the purposes of the present disclosure, the arrangement shown in FIG. 1 may be duplicated using more tiles and fasteners than what is shown in FIG. 1.

Figure 2:
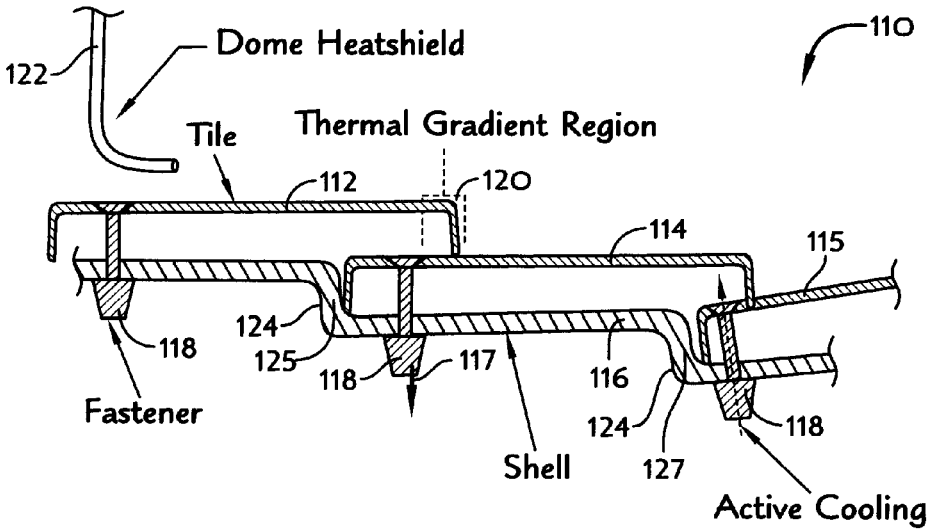
FIG. 2 is a top view of a CMC combustor liner in a second embodiment of the present disclosure in which the plurality of tiles are arranged in an "overlapping" arrangement.

Referring now to FIG. 2, a second embodiment of the present disclosure of a CMC combustor liner 110 is shown. The second embodiment 110 is an "overlapped" or "shingled" tile arrangement in which a first tile 112 overlaps a second tile 114, and the second tile 114 overlaps a third tile 115. The first tile 112 engages the second tile 114, and the second tile 114 engages the third tile 115. Each tile 112, 114, 115 is fastened to a shell 116 using metallic fasteners 118 that extend through the shell 116 and each tile 112, 114, 115. Each metallic fastener 118 is proximate one end of the tile, and only one fastener 118 is used to secure each of the tiles 112, 114, 115 (rather than two fasteners securing each tile as in the first embodiment). As a result, axial growth of the shell 116 and the tiles 112, 114, 115 in the direction 117 caused by heat is less restricted and thermal stress management is improved.

The forward-most tile 112 and the fastener 118 are sheltered from heat generated by the combustor by a heat shield 122 that overhangs the tile 112 as shown in FIG. 2. The tile 114 and the fastener 118 are sheltered from heat generated by the combustor by the tile 112 which overhangs the tile 114. The tile 115 and the fastener 118 are sheltered by the tile 114 which overhangs the tile 115. A thermal gradient region 120 is established in an area adjacent to the attachment region between each fastener 118 and the associated tile. Unlike the first embodiment 10, in which the thermal gradient region 20 surrounds the attachment region between each tile and each fastener 18, the thermal gradient 120 of the second embodiment 110 may be managed by adjusting the degree of overlap between each tile.

As shown in FIG. 2, joggles 124 are formed in the shell 116 to permit the "overlapping" tile arrangement. No joggles are formed in the shell 16 of the first embodiment 10. For the purposes of the present disclosure, the arrangement shown in FIG. 2 may be duplicated using more tiles and fasteners than what is shown in FIG. 2.

Referring again to FIG. 2, a method for assembling a CMC combustor liner using the tiles 114, 115 first includes positioning a first end of the second tile 114 against a joggled portion 125 of the shell 116. The method includes positioning the third tile 115 against a second joggled portion 127 of the shell 116 so that a second end of the second tile 114 engages the third tile 115 and the second tile 114 overlaps the third tile 115. The method further includes fastening the second tile 114 to the shell 116 using one of the fasteners 118. The method further includes fastening the third tile 115 to the shell 116 using one of the fasteners 118 so that the third tile 115 and the fastener 118 used to secure the third tile 115 to the shell 116 are sheltered from heat generated by the combustor by the second tile 114.

Figure 3:
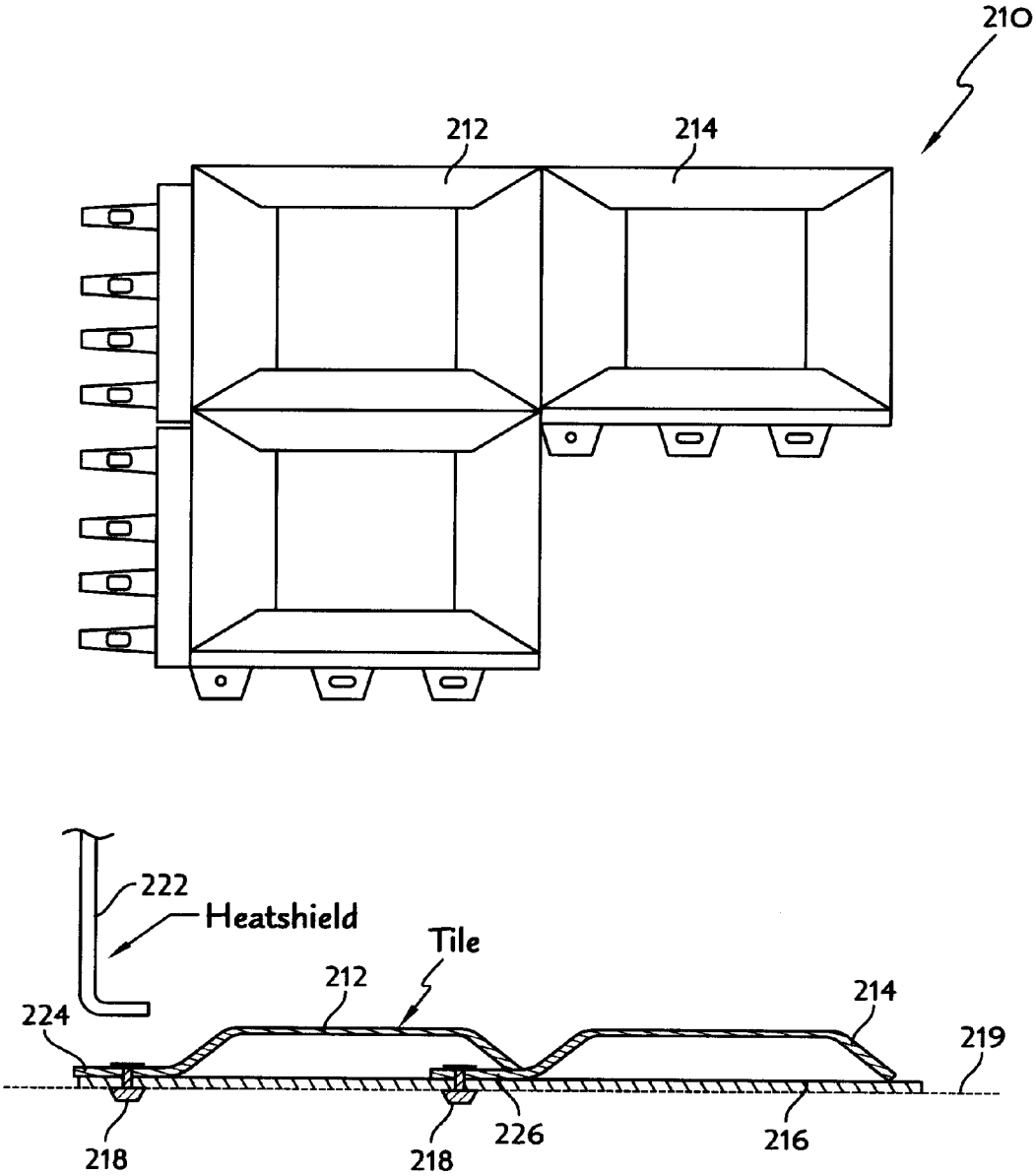
FIG. 3 is a plan and top view of a CMC combustor liner in a third embodiment of the present disclosure in which each tile includes a flange and the plurality of tiles are arranged such that each flange is positioned beneath a neighboring tile.

Referring now to FIG. 3, a third embodiment of the present disclosure of a CMC combustor liner 210 is shown. A plurality of tiles are shown including a first tile 212 and second tile 214. The first tile 212 has a flange 224 interfacing with a shell 216, and a first fastener 218 is used to secure the flange 224 to the shell 216. The second tile 214 has a flange 226 interfacing with the shell 216, and a second fastener 218 is used to secure the flange 226 to the shell 216. Though not shown in FIG. 3, a plurality of fasteners may be positioned in substantially perpendicular relation to the first and second fasteners 218 (i.e. along the axis 219) to prevent the tiles 212, 214 from vibrating relative to the shell 216.

As shown in FIG. 3, the first tile 212 is positioned relative to the second tile 214 such that the flange 226 of the second tile 214 subtends the corner of the first tile 212. The flange 226 is tucked in beneath the first tile 212 relative to the shell 216 as shown in FIG. 3. The forward-most first tile 212 is sheltered by a heat shield 222 that overhangs the first tile 212, similar to the heat shield 122 of the second embodiment 110.

Similar to the first embodiment 10 and unlike the second embodiment 110, no joggles are formed in the shell 216 of the third embodiment 210. For the purposes of the present disclosure, the arrangement shown in FIG. 3 may be duplicated using more tiles and fasteners than what is shown in FIG. 3.

The tiles 212, 214 may be dished shaped as shown in FIG. 3. However, the tiles 212, 214 may be substantially rectangular such that each tile 212, 214 has corners and each tile 212, 214 has portions substantially perpendicular to the shell 216.

The principal embodiments of the CMC combustor liner are shown in FIGS. 1-3. Other features which may be added to the principal embodiments include brackets and low thermal conductivity insulating components to shield heat transfer from the hot CMC tiles to the wall.

Figure 4:
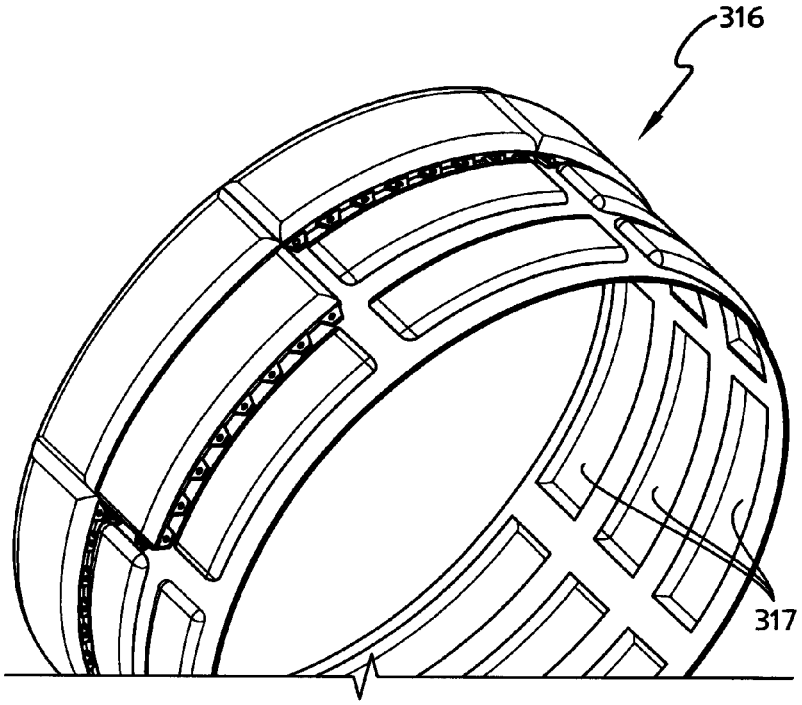
FIG. 4 is a perspective view of a dimpled shell configured for attachment to the plurality of tiles.
Figure 5:
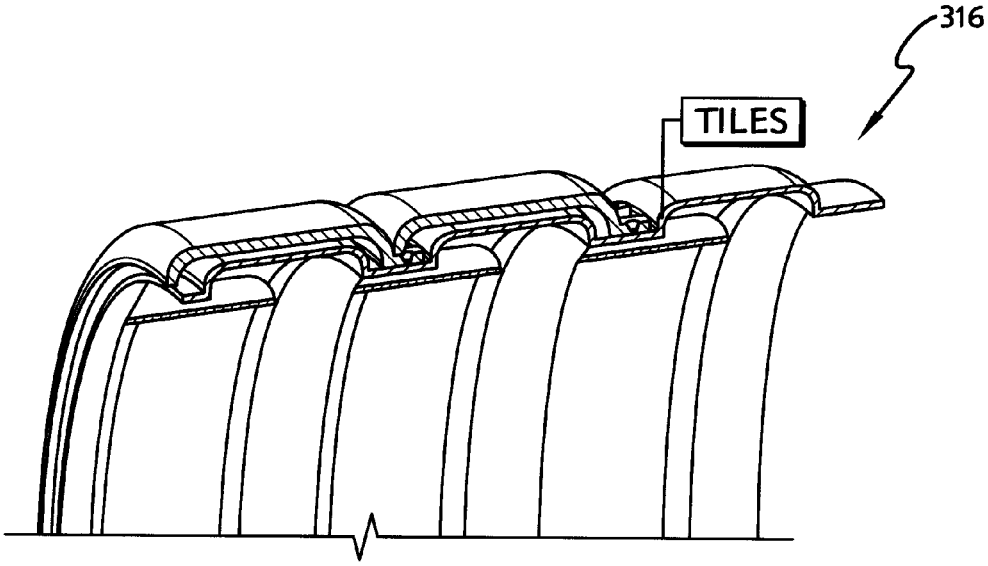
FIG. 5 is a sectional view of the dimpled shell of FIG. 4 taken about the line 4-4 and showing the plurality of tiles coupled to the shell.

Referring now to FIGS. 4-5, a shell 316 is shown that includes a plurality of dimples 317. The shell 316 is configured to receive tiles in each of the dimples 317, such as the tiles described in the first embodiment 10, the second embodiment 110, or the third embodiment 210. The tiles received in the dimples 317 may be secured to the shell 316 using metal fasteners, such as the metal fasteners described in the first embodiment 10, the second embodiment 110, or the third embodiment 210.

As indicated above with respect to the first embodiment, fasteners used to secure the tiles to the shell require active cooling during use. The dimples 317 formed in the shell 316 reduce the distance between the shell 316 and the tiles to enhance heat transfer on the back of the tiles and thereby improve cooling. The dimples 317, as discussed below, may increase convective heat transfer between the shell 316 and the tiles and enhance impingement cooling thereby.

Thermal gradients, such as the thermal gradient regions 20, 120, associated with the CMC combustor liner are managed using well known heat transfer conduction and convection technologies. For example, impingement cooling involves using one or more streams of a fluid (i.e. one or more streams of air produced using "jets") to impinge on a surface and thereby increase the convective heat transfer coefficient to effect increased cooling. Impingement cooling may be used to manage the thermal gradient regions 20, 120. The dimples 317 of the shell 316 may increase convective heat transfer between the shell 316 and the tiles so that impingement cooling is enhanced. In another example, effusion cooling involves passing coolant through arrays of closely spaced holes formed in a surface to effect increased cooling of the surface. Effusion cooling may also be used to manage the thermal gradient regions 20, 120.

Referring now to FIG. 5, the dimpled shell 316 is shown coupled to tiles such as the tiles 12, 14 of the first embodiment 10. Joggles are not formed in the shell 316 to permit the "overlapping" arrangement described in the second embodiment 110. For the purposes of the present disclosure, the shell 316 may be used with the tiles 12, 14 of the first embodiment or the tiles 212, 214 of the third embodiment 210.

CMC material starts off as overlapping leaves of woven fiber. Forming the CMC material in three dimensions complicates the process of making the tiles (i.e. any of the tiles of the first-third embodiments) and also complicates the process for making the dimpled shell 316. The forming of the dimpled shell 316 may require both a stamping and a rolling process, and the rolling process may require special tooling in order to preserve the stamped dimpled shape while making the overall shape cylindrical. Therefore, it is desirable for the sake of manufacturing simplicity to define an essentially "two dimensional" tile arrangement. For the purpose of the present disclosure, the phrase "two dimensional" means that the tiles can be formed without cutting or joining the fibers of the CMC material.

Figure 6:
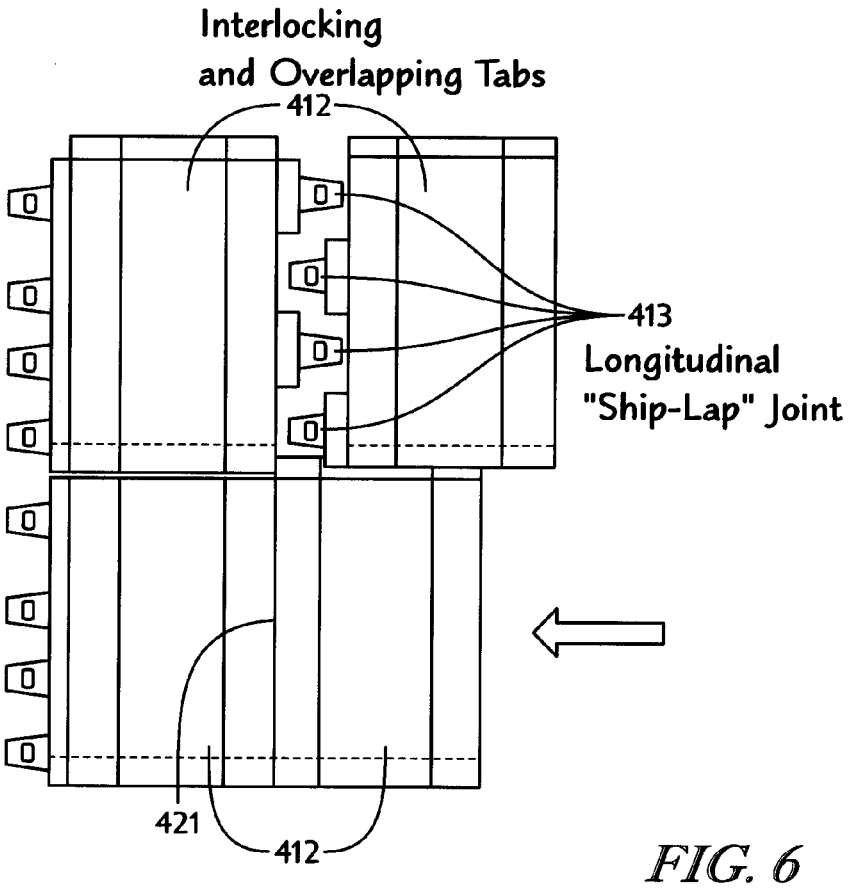
FIG. 6 is a top plan view of the plurality of tiles in which each tile includes one or more interlocking tabs and neighboring tiles are coupled to one another using the interlocking tabs.

Referring to FIG. 6, a plurality of tiles 412 including interlocking tabs 413 are shown. Each of the plurality of tiles 412 is illustratively formed using shaping only in two dimensions so that the tiles 412 are essential two-dimensional (i.e. no cutting or joining of the fibers of the CMC material). As discussed below, the interlocking tabs 413 effect a coupling between neighboring tiles 412 that prevents the tiles 412 from vibrating excessively while the CMC combustor liner is being used.

The tiles 412 interface with one another as shown in FIG. 6 so that neighboring tiles 412 are secured to one another fore and aft, or lengthwise. For example, in the second row shown in FIG. 6, two tiles 412 are positioned for interlocking along the length of each tile 412. Each interlocking tab 413 of each tile 412 is configured to be positioned beneath the neighboring tile 412 so that neighboring tiles 412 are interlocked as shown in FIG. 6. The joint defined as each tab 413 is positioned beneath the neighboring tile 412 is a "ship lapped" joint 421 that provides a labyrinth-like seal path between interlocked tiles 412 as suggested in FIG. 6. The "ship lapped" joint 421 may be further enhanced by forming grooves and teeth in each tile 412 and engaging the teeth of one tile 412 with the grooves of the neighboring tile 412, for instance. The "ship lapped" joint 421 defined as a result of the positioning of interlocking tabs 413 between neighboring tiles 412 forms a seal between neighboring tiles 412 as suggested in FIG. 6.

The positioning of each interlocking tab 413 beneath the neighboring tile 412 provides sufficient stiffness so that the tiles 412 are prevented from vibrating excessively while the CMC combustor liner is being used. However, the use of the "shipped lapped" joint 421 as described above results in an uneven heat load applied to the interlocking tabs 413 positioned beneath the tiles 412 and the portions of the tiles 412 positioned above the interlocking tabs 413.

Figure 7:
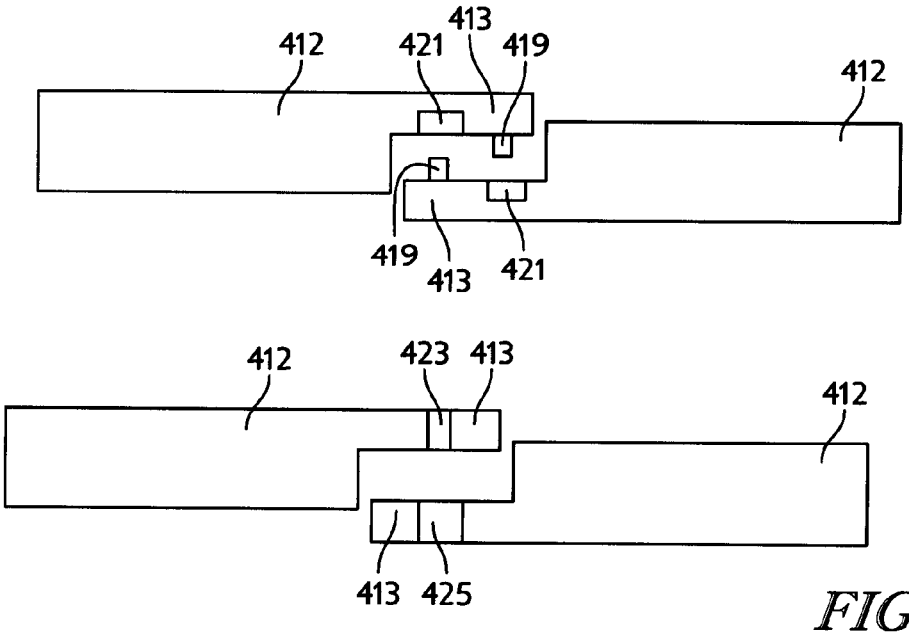
FIG. 7 is a top view of the plurality of tiles in which each tile includes mating features and neighboring tiles are coupled to one another using the mating features.

Referring now to FIG. 7, a labyrinth-like seal is established between neighboring tiles 412 by using interlocking tabs 413 that include mating features such as a tab 419 and a slot 421. As suggested in FIG. 7, neighboring tiles 412 are interlocked using interlocking tabs 413 when the tab 419 of one tile 412 is received in the slot 421 of the neighboring tile 412. The joint established as a result of interlocking neighboring tiles 412 using the interlocking tabs 413 may reduce leakage between neighboring tiles 412. In addition, the mating features do not require the interlocking tabs 413 to be positioned beneath the neighboring tile 412 and therefore avoid the uneven heat load issue discussed above with respect to the tiles 412 in FIG. 6. As suggested in FIG. 7, the mating features permit the heat load to be applied relatively evenly between the upper and lower portions 423, 425 of the joint.

For the purpose of the present disclosure, the interlocking tabs 413 discussed with respect to FIGS. 6 and 7 are not used on either the first tile or the last tile of the CMC combustor liner. The first (i.e. forward-most) tile 12, as indicated in FIG. 1 for example, is fastened to the shell 16 using one or more of the fasteners 18 and sheltered by the heat shield 22. The last tile, as discussed below, is fastened to the shell 16 and receives protection from heat therefrom.

Figure 8:
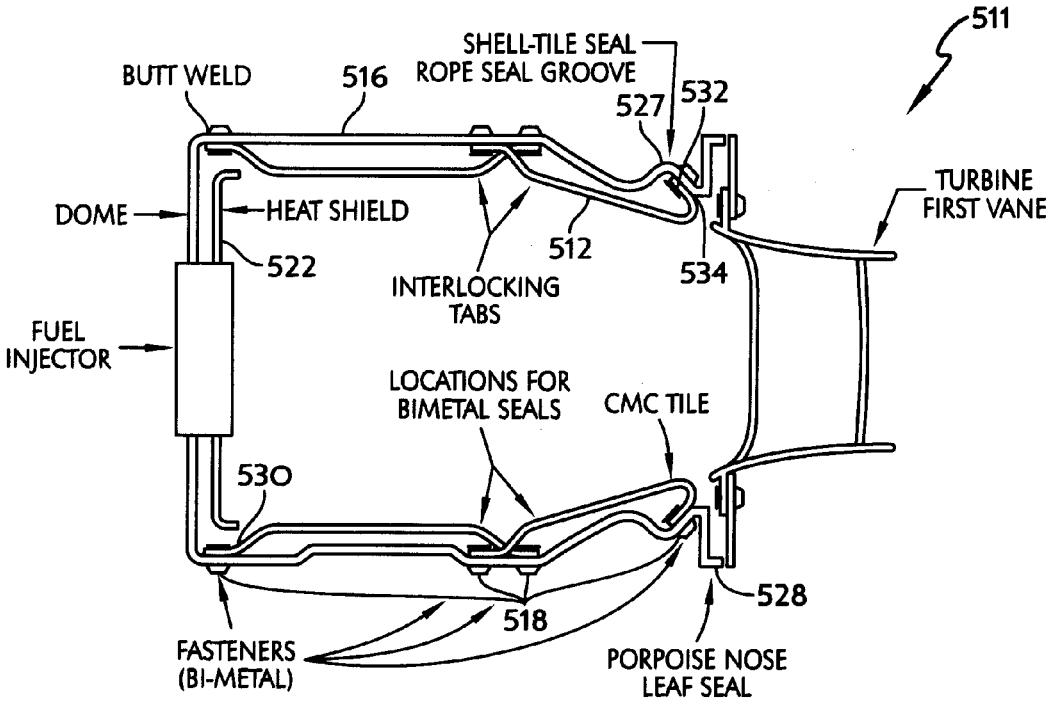
FIG. 8 is a top view of a combustor chamber utilizing a CMC combustor liner in which a curled portion of the rearmost tile of the plurality of tiles is coupled to the shell.

Referring now to FIG. 8, a combustor chamber 511 is shown. A shell 516 positioned within the combustion chamber 511 has a V-shaped notch 527 in which the last tile 512 of the CMC combustor liner is received. The last tile 512 illustratively has a "toboggan" feature (i.e. a curled portion) that is received in the notch 527 as shown in FIG. 8. A porpoise noise and leaf seal 528, a heat shield 522 butt welded to the shell 516, bimetallic fasteners 518, and bimetallic seals 530 are positioned within the combustion chamber 511 as shown in FIG. 8. A groove 532 is included in the last tile 512 and the groove 532 may be sealed using a ceramic rope seal 534 to seal the interface between the last tile 512 and the shell 516. For the purpose of the present disclosure, the interlocking/mating features described above are only used for tiles that are on the internal portions of the flow path.

Figure 9:
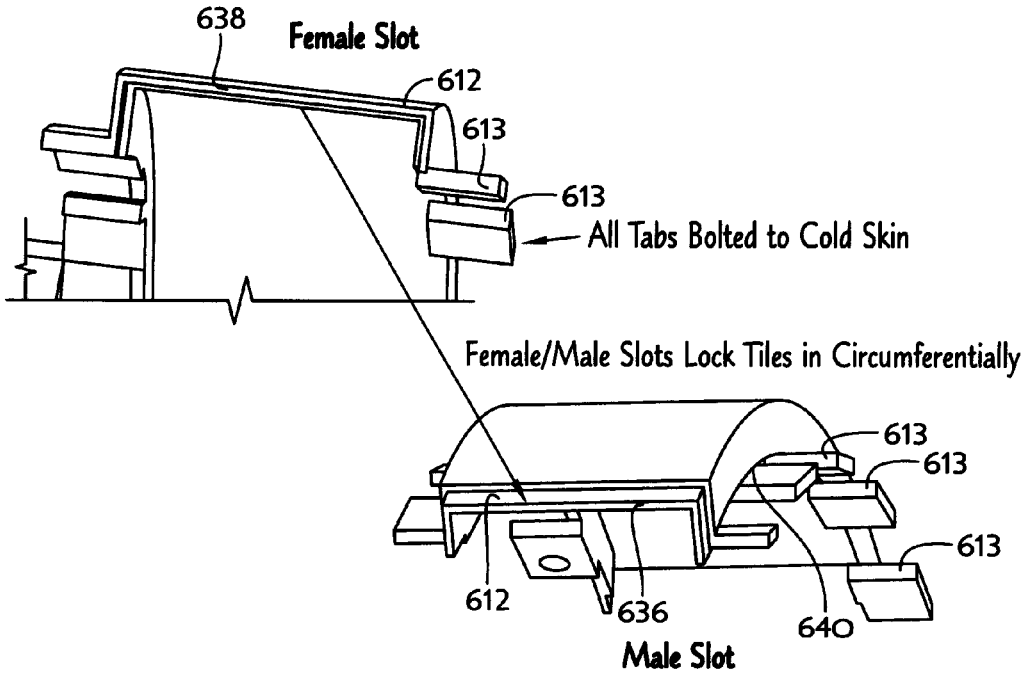
FIG. 9 is a cross-sectional view of one tile including a female slot and a front perspective view of another tile including a male slot that is received in the female slot of the other tile.
Figure 10:
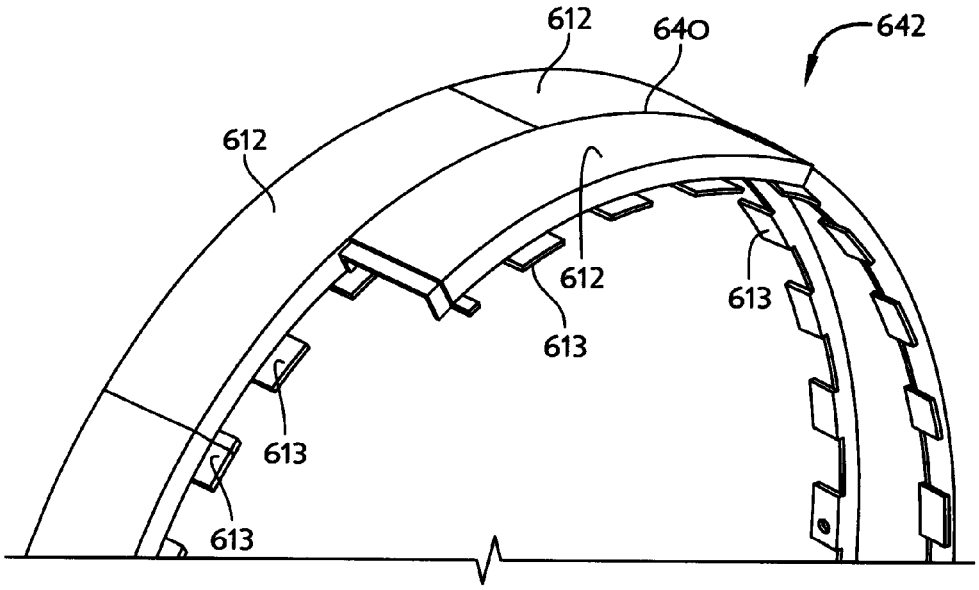
FIG. 10 is an assembly view showing the tiles of FIG. 9 attached in a first row and at least one other tile positioned adjacent thereto in a second row.

Referring now to FIGS. 9-10, a male slot 636 of one tile 612 is configured to be received in a female slot 638 of another tile 612 so that the tiles 612 are circumferentially locked to one another. Each of the tiles 612 includes tabs 613 that cooperate to establish the "ship-lapped" edge 640 shown in FIGS. 9-10. The tiles 612 are coupled to form a tile assembly 642 that presents a clean face to the combustor hot section as suggested in FIG. 10.

Figure 11:
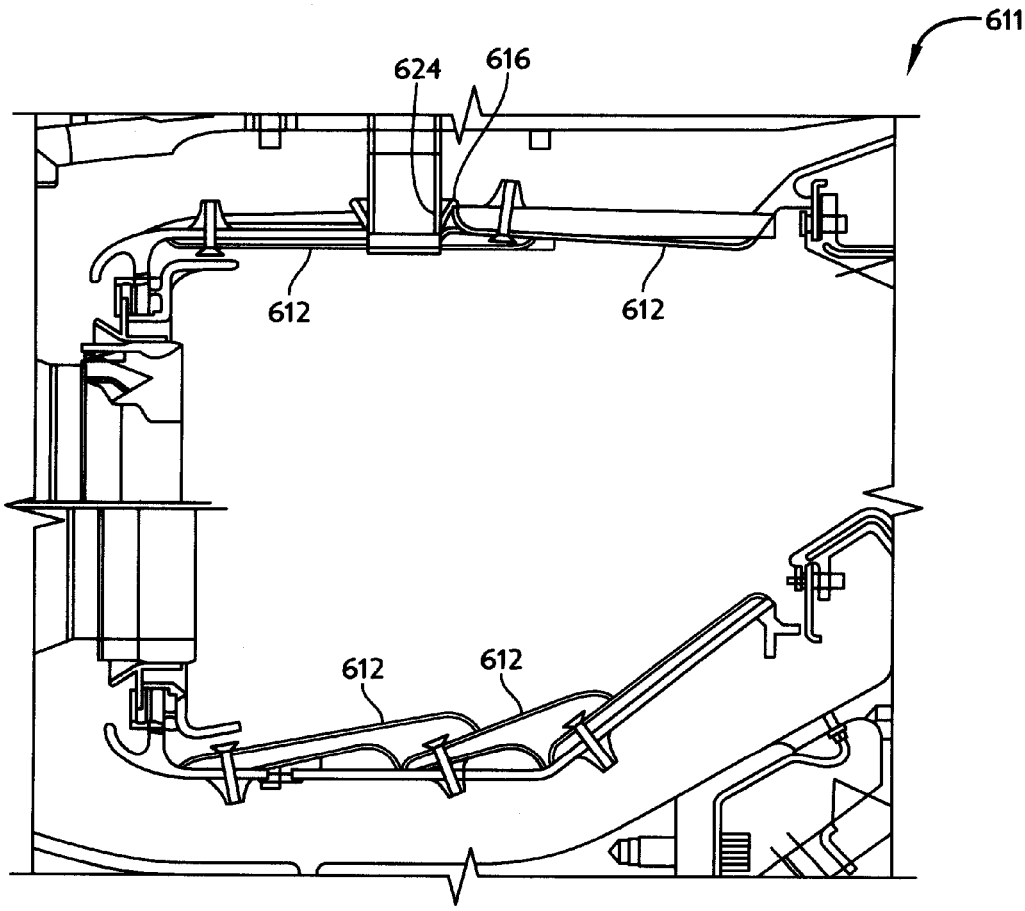
FIG. 11 is a top view of a combustor chamber utilizing a CMC combustor liner including overlapping tiles and a shell having a plurality of joggles formed therein.

Referring now to FIG. 11, tiles 612 are positioned within a combustion chamber 611 and are arranged in the "overlapping" arrangement discussed above with respect to the second embodiment 110. There are no tabs adjacent to the shell 616, and the tiles 612 overlap. Each tile 612 is fastened only on a single end. The shell 612 includes joggles 624 as shown in FIG. 11. The shell 616 is joggled in a two-dimensional fashion to close the distance between the tile 612 and the shell 616. For the purpose of the present disclosure, the "overlapping" arrangement shown in FIG. 11 may utilize the bimetallic fasteners 518 of FIG. 8 (i.e. using a washer on the outside of the shell 616 to keep the tile 612 pulled against the shell 616 at all temperatures), the bimetallic seals 530, or the groove 532 and the ceramic rope seal 534 of FIG. 8 to discourage leaks.

The "overlapped" tiles 612 do not expose any of the fasteners to the hot gasses of the combustor. The tiles 612 are "ship-lapped" circumferentially as described above to discourage leaks. The tiles 612, with the exception of the forward-most tile 612, may be circumferentially segmented into tabs to relieve any circumferential growth issues. However, one drawback to the "overlapping" arrangement is that the outermost portion of each overlapped tile 612 is spaced apart from the shell 616, so much so that impingement heat transfer may not be adequate. It is estimated that the "overlapped" arrangement has approximately 67% of the cooling effectiveness of a similar impingement effusion liner relative to a simple effusion liner. Typically, impingement effusion liners tend to provide approximately a 30% improvement relative to simple effusion liners. It is estimated therefore that the "overlapped" arrangement provides approximately a 20% improvement to simple effusion liners.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor for use in a gas turbine engine, the combustor comprising an annular metallic shell forming an annular cavity, and an annular liner arranged in the annular cavity of the annular metallic shell and defining an annular combustion chamber, the annular liner including a first ceramic tile coupled to the metallic shell by a first fastener extending through the first ceramic tile and a second ceramic tile coupled to the metallic shell by a second fastener extending through the second ceramic tile, wherein an overlapped portion of the first ceramic tile is arranged to extend between the second fastener that extends through the second ceramic tile and the annular combustion chamber to shield the second fastener from the annular combustion chamber, wherein the annular metallic shell is formed to include portions that define dimples, the portions that define the dimples extending outward in a radial direction away from a central axis of the combustor around which the combustion chamber extends.

2. The combustor of claim 1, further comprising a heat shield arranged to extend between the first fastener that extends through the first ceramic tile and the annular combustion chamber to shield the first fastener from the annular combustion chamber.

3. The combustor of claim 1, wherein the annular metallic shell is formed to include joggles extending inwardly in a radial direction toward a central axis of the combustor around which the combustion chamber extends.

4. The combustor of claim 1, wherein the first ceramic tile is formed to include a radially-inwardly opening hollow sized and arranged to receive at least a portion of one of the dimples included in the annular metallic shell.

5. The combustor of claim 4, wherein the second ceramic tile is formed to include a radially-inwardly opening hollow sized and arranged to receive at least a portion of another one of the dimples included in the annular metallic shell.

6. The combustor of claim 1, wherein the first fastener and the second fastener are formed to include passages configured to receive active cooling air.

7. The combustor of claim 2, further comprising at least one fuel nozzle arranged to inject fuel into the annular combustion chamber.

8. The combustor of claim 1, wherein the second ceramic tile includes a body and at least one tab extending from the body.

9. A combustor for use in a gas turbine engine, the combustor comprising an annular metallic shell forming an annular cavity, and an annular ceramic tiled liner arranged in the annular cavity of the annular metallic shell and defining an annular combustion chamber, the annular ceramic tiled liner including a first ceramic tile coupled to the metallic shell by a first fastener extending through the first ceramic tile and a second ceramic tile coupled to the metallic shell by a second fastener extending through the second ceramic tile, wherein a portion of the first ceramic tile is arranged to overlap the second fastener that extends through the second ceramic tile and a portion of the second ceramic tile arranged around the second fastener to shelter the second fastener and the portion around the second fastener from heat generated in the annular combustion chamber, wherein the annular ceramic tiled liner includes a last ceramic tile, the annular metallic shell includes a V-shaped notch in which the last ceramic tile is received, and the last ceramic tile includes a curled portion that is received in the V-shaped notch.

10. The combustor of claim 9, wherein the first and second ceramic tiles include interlocking tabs and the interlocking tabs are positioned between the first or second ceramic tile and the annular metallic shell.

11. The combustor of claim 10, wherein the interlocking tabs extend circumferentially around the annular combustion chamber.

12. The combustor of claim 10, wherein the first and second ceramic tiles are formed from a ceramic matrix composite material and the first and second ceramic tiles are formed without cutting or joining fibers of the ceramic matrix composite material such that the first and second ceramic tiles are essentially two-dimensional.

13. The combustor of claim 10, wherein the interlocking tabs extend longitudinally along the annular combustion chamber.

14. The combustor of claim 9, wherein each fastener used to secure one of the first and second ceramic tiles is arranged proximate to one end of each of the corresponding first and second ceramic tiles.

15. The combustor of claim 14, wherein the first and second ceramic tiles include interlocking tabs and the interlocking tabs are positioned between the first or second ceramic tile and the annular metallic shell.

* * * * *